US011773692B2

(12) United States Patent
Chalker

(10) Patent No.: US 11,773,692 B2
(45) Date of Patent: Oct. 3, 2023

(54) PULSE BASED PERF AND WASH SYSTEM AND METHOD

(71) Applicant: GEODYNAMICS, INC., Millsap, TX (US)

(72) Inventor: Chris Chalker, Aberdeen (GB)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 17/285,110

(22) PCT Filed: Oct. 2, 2019

(86) PCT No.: PCT/US2019/054257
§ 371 (c)(1),
(2) Date: Apr. 14, 2021

(87) PCT Pub. No.: WO2020/081234
PCT Pub. Date: Apr. 23, 2020

(65) Prior Publication Data

US 2021/0348480 A1 Nov. 11, 2021

Related U.S. Application Data

(60) Provisional application No. 62/854,565, filed on May 30, 2019, provisional application No. 62/747,314, filed on Oct. 18, 2018.

(51) Int. Cl.
*E21B 37/08* (2006.01)
*E21B 41/00* (2006.01)
(Continued)

(52) U.S. Cl.
CPC ..... *E21B 37/08* (2013.01); *E21B 33/13* (2013.01); *E21B 41/0078* (2013.01); *E21B 43/117* (2013.01)

(58) Field of Classification Search
CPC ..... E21B 37/08; E21B 37/00; E21B 33/13; E21B 41/0078; E21B 43/11; E21B 21/00; E21B 43/116
See application file for complete search history.

(56) References Cited

U.S. PATENT DOCUMENTS 8,528,649 B2 9/2013 Kollé
8,939,217 B2 1/2015 Kolle
(Continued)

FOREIGN PATENT DOCUMENTS

CN 109184631 A * 1/2019
WO 2016046521 A1 3/2016
WO 2018144901 A1 8/2018

OTHER PUBLICATIONS

International Search Report / Written Opinion dated Jan. 6, 2020 in related/corresponding PCT Application No. PCT/US2019/054257.

*Primary Examiner* — Zakiya W Bates
(74) *Attorney, Agent, or Firm* — Morgan, Lewis & Bockius LLP

(57) ABSTRACT

A perf and wash system for plugging a casing and wellbore, the perf and wash system including a cleaning tool having at least one nozzle making a first angle with a longitudinal axis of the system; a perforating gun assembly having at least one shaped charge making a second angle with the longitudinal axis; and a plug connected with a first end to the cleaning tool and with a second end, opposite to the first end, to the perforating gun assembly. The first angle is substantially equal to the second angle and the first and second angles are different than 90 degrees.

22 Claims, 21 Drawing Sheets

(51) Int. Cl.

| | |
|---|---|
| ***E21B 43/117*** | (2006.01) |
| ***E21B 21/00*** | (2006.01) |
| ***E21B 33/13*** | (2006.01) |

(56) References Cited

U.S. PATENT DOCUMENTS

| | | | |
|---|---|---|---|
| 9,038,521 | B1 | 5/2015 | Rollins et al. |
| 9,057,262 | B2 | 6/2015 | Kolle |
| 9,249,642 | B2 | 2/2016 | Kolle |
| 9,562,421 | B2 | 2/2017 | Hardesty et al. |
| 2004/0060698 | A1 | 4/2004 | Ravensbergen et al. |
| 2013/0092246 | A1 | 4/2013 | Kolle |
| 2013/0312963 | A1 | 11/2013 | Larsen et al. |
| 2014/0138078 | A1 | 5/2014 | Lerbrekk et al. |
| 2014/0231546 | A1 | 8/2014 | Etschel et al. |
| 2016/0108691 | A1 | 4/2016 | Kolle |
| 2016/0194937 | A1 | 7/2016 | Myhre et al. |
| 2017/0067313 | A1 | 3/2017 | Connell et al. |
| 2018/0073327 | A1 | 3/2018 | Theimer et al. |
| 2018/0187518 | A1 | 7/2018 | Myhre et al. |

* cited by examiner

PULSE BASED PERF AND WASH SYSTEM AND METHOD

BACKGROUND

Technical Field

Embodiments of the subject matter disclosed herein generally relate to downhole tools for well operations, and more specifically, to a pert and wash system that uses pulsed jets for cleaning an underground annulus prior to placing a cement plug in a well.

Discussion of the Background

To extract the oil and/or gas from reservoirs located underground, in the so called formations 102, it is necessary to drill a well 104 to a desired depth H relative to the surface 106, to install a casing 108 into the well and then to cement the casing to the wellbore, as shown in FIG. 1. The cement 110 is placed between the outside of the casing 108 and the wall of the well. In some wells but not all, a gun system (not shown) is lowered into the casing and the casing is perforated with shaped charges of the gun, for establishing a connection between the casing 108 and the formation 102. Plural perforation holes 112 (holes herein) are made through the casing 108 and the cement 110 as also shown in the figure. The holes 112 are typically made to be perpendicular to the longitudinal axis X of the casing 108. Oil in the formation 102 is then flowing into the casing 108 through the holes 112 and then into the bore 109, and various methods are used to bring the oil to the surface.

After the oil production at the well falls under a certain rate per day, various interventions methods are used to increase the oil flow. After some or all of these methods are used to increase the oil flow, eventually the well production declines and the oil flow falls again below a rate that is not economically sustainable. At that time, the operator of the well might decide to close the well and abandon it. To do so, the wellbore 109 needs to be plugged so that no fluids or gases from the formation or from the well escape to the surface.

A well that is going to be abandoned is typically plugged with cement. However, to successfully place a cement plug and to ensure that the plug will stay there for a long time, a couple of requirements needs to be fulfilled. First, the well needs to have the casing milled and removed or alternatively be initially perforated or have further perforations added to make larger holes at higher shot density into the casing. Cement plugs can be placed anywhere in the wellbore for abandonment purposes, however with regard to FIG. 1, the cement plug is placed above the most upstream holes 112 made in the well for oil extraction. This means that the plug needs to be placed at position 120 and the new holes 122 should be made in the casing just upstream and downstream of that position. Second, the cement 110A and 1108 that already exists behind the casing 108, around the position 120, may need to be removed if it is determined to be below standard (i.e., broken up and flushed out) so that the cement of the new abandonment plug can enter through the holes 122, between the wellbore wall and the casing 108. This would ensure that the cement plug is fixedly attached to the casing and would not slip up or down in the casing over time and would also adhere to the casing and wellbore preventing the movement of oil, gas or formation water. Third, the interior of the casing at position 120 needs to be cleaned out so that the plug's cement achieves a strong bond with the casing and also the debris behind the casing, formed in the annulus between the casing and the wellbore, needs to be cleaned out. It should also be noted that some wells have multiple strings of casing adjacent to each other and at any time it may be required to clean between any individual casings or clean between all casings and the reservoir prior to placing the abandonment plug.

Note that the debris from the well, if not completely removed from the annulus, leaving it in a clean state, can lead to the failure, either initially or in time, of the cement plug that is circulated into place to isolate the wellbore and the annulus from the surface. A failed cement plug has the potential to allow hydrocarbons or formation water from the formation 102 to migrate to the surface 106 of the abandoned well 100, creating an environmental disaster.

To achieve these objectives, a perf and wash system can be used. A perf and wash system includes a perforating gun system and a set of cleaning tools that are attached to each other. The gun system achieves the holes 122 and the cleaning tool cleans the cement from the annulus. However, the current perf and wash systems have certain drawbacks. One such drawback is the efficiency of the system. The efficiency of the system is limited because the holes 122 are made perpendicular to the casing 108 while the nozzles used by the cleaning tool are either perpendicular to the casing as shown in FIG. 2A or inclined with a certain angle to the casing, as illustrated in FIG. 2B. FIG. 2A shows the cleaning device 200 located next to the hole 122 and having a nozzle 202 (only one shown for simplicity) that ejects a water stream 204 perpendicular to the casing 108, into the cement 110A located behind the casing. FIG. 2B shows a similar configuration, but the nozzle 202 is inclined relative to the casing so that the water stream 204 enters at an angle in the hole 122.

Either configuration has a limited reach behind the casing 108, and thus, the cement 110A might not be effectively removed between the plural holes 122 formed in the casing 108. In addition, the existing perf and wash systems use a continuous fluid stream 204 for removing the cement 110A and cleaning the casing 108, which sometime fails to achieve a good quality.

Thus, there is a need to provide a more efficient perf and wash that overcomes the deficiencies noted above.

SUMMARY

According to an embodiment, there is a perf and wash system for plugging a casing and wellbore. The perf and wash system includes a cleaning tool having at least one nozzle making a first angle with a longitudinal axis of the system, a perforating gun assembly having at least one shaped charge making a second angle with the longitudinal axis, and a plug connected with a first end to the cleaning tool and with a second end, opposite to the first end, to the perforating gun assembly. The first angle is substantially equal to the second angle and the first and second angles are different than 90 degrees.

According to another embodiment, there is a perf and wash system for plugging a casing, the perf and wash system including a cleaning tool having at least one nozzle, a perforating gun assembly having at least one shaped charge, and a plug connected with a first end to the cleaning tool and with a second end, opposite to the first end, to the perforating gun assembly. The cleaning tool is configured to generate a pulsing water jet through the at least one nozzle.

According to still another embodiment, there is a method for cleaning a casing in a well, and the method includes selecting a perforating gun assembly having at least one shaped charge making a first angle with a longitudinal axis of the casing, selecting a cleaning tool having at least one nozzle making substantially the first angle with the longitudinal axis, wherein the cleaning tool is configured to generate a pulsed water jet through the at least one nozzle, connecting a plug with a first end to the cleaning tool and with a second end, opposite to the first end, to the perforating gun assembly, to form a perf and wash system, lowering the perf and wash system into the casing, and cleaning the casing with the pulsed water jet of the cleaning tool.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a perf and wash system that uses a pulse assisted cleaning tool for removing cement or other debris from an annulus formed between a wall of a well and a casing or between two casings. However, the embodiments discussed herein are applicable to perf and wash systems that use traditional cleaning devices or to remove other materials from between two casings or between a casing and a string that are used inside the well.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a perf and wash system includes a pulse assisted cleaning tool and a perforating gun assembly that is configured to fire the shaped charges at a given angle relative to the casing and to send pulse assisted water jests at a matching angle into the casing.

Figure 3:
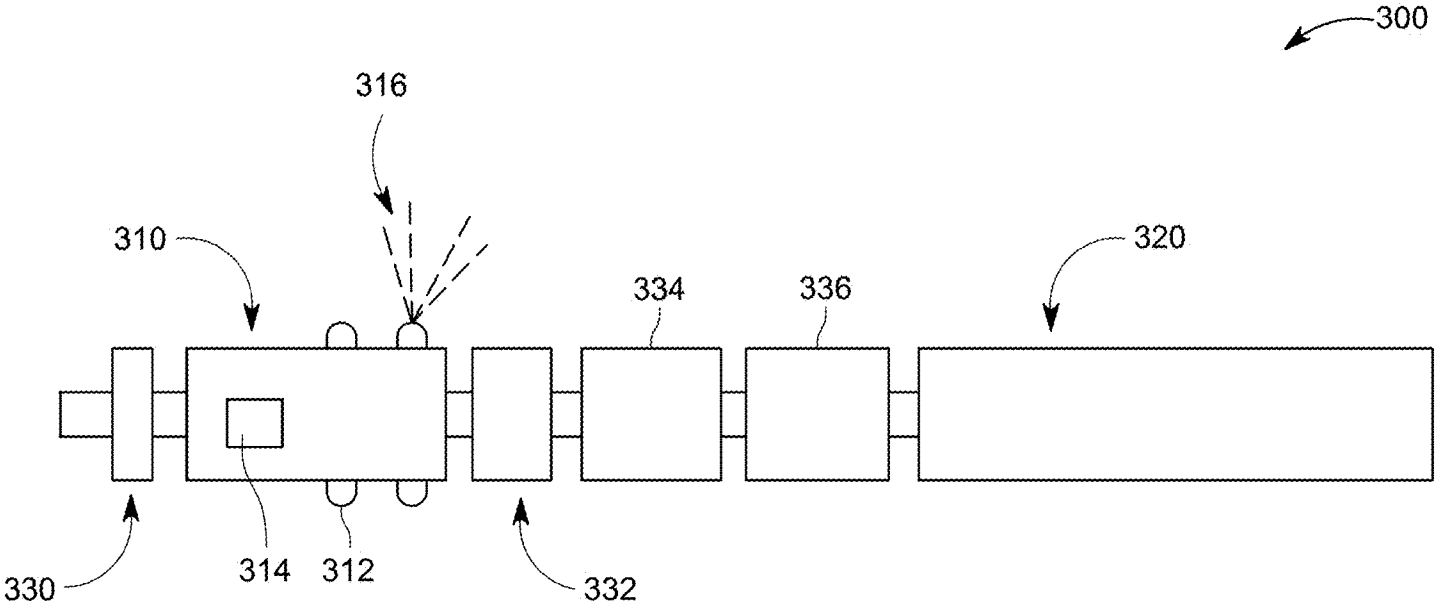
FIG. 3 illustrates a novel perf and wash system for cleaning a well in anticipation of placing a cement plug.

More specifically, as illustrated in FIG. 3, the perf and wash system 300 includes a cleaning tool 310 and a perforating gun assembly 320. The cleaning tool 310 may be connected to each end to a bypass/circulating valve 330 and 332. Other downhole tools may be connected either to the cleaning tool or the perforating gun assembly as necessary. A cement base assembly plug 334 may be connected between the cleaning tool 310 and the perforating gun assembly 320. The perforating gun assembly 320 may be connected with an automatic gun release module 336, which may be attached to the cement base assembly plug 334. An automatic gun release module is configured to release the perforating gun assembly 320 from the perf and wash system when a signal is sent from the surface, for example, an increase in the well pressure.

The cleaning tool 310 is shown having plural nozzles 312 and a pulse generating module 314. The pulse generating module is known in the art, and is described, for example, in U.S. Pat. Nos. 8,528,649, 8,939,217, 9,057,262, 9,249,642 and U.S. Patent Application Publication Nos. 2013/0092246, 2016/0108691, and 2018/0073327. Other modules for generating a pulsed jet (also known as a water hammer effect) exist and can be used. The pulse generating module 314 may include any of the existing technologies as long as it generates a hammer effect on the generated water jet. Each nozzle 312 is configured to release a corresponding pulsed water jet 316 with a changing force for cleaning the well.

Figure 4A:
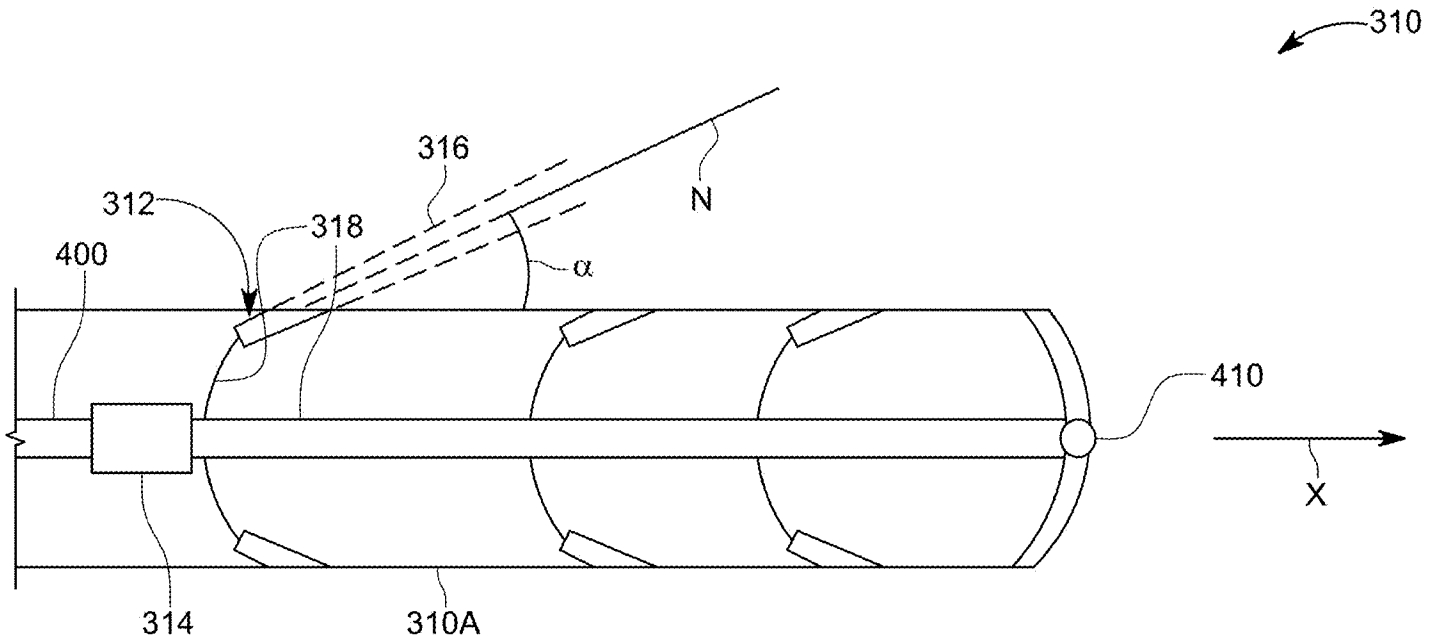
FIGS. 4A to 4D illustrate various configurations of a cleaning tool of the novel perf and wash system.

Different cleaning tools 310 may have different orientations for their nozzles. For example, as illustrated in FIG. 4A, the cleaning tool 310 is configured to have all the nozzles 312 oriented with an angle $\alpha$ relative to a longitudinal axis X of the tool. In this regard, FIG. 4A shows that a jet axis N of a nozzle 312 makes the angle $\alpha$ with the longitudinal axis X. The angle $\alpha$ is acute in the embodiment of FIG. 4A, which means, that when the cleaning tool 310 is deployed inside a well, the nozzles 312 point in a downward direction, i.e., toward the toe of the well. FIG. 4A also shows that the pulse generating module 314 is located inside a body 310A of the cleaning tool 310, and it is connected by corresponding tubing 318 to each nozzle. The pulse generating module 314 is configured to receive a fluid stream 400 from upstream, for example, from a coil tubing or from the well, and this fluid stream 400 is modulated to act as a pulsing jet, e.g., as a hammer. The pulsing jet is then split into individual pulsing jets 316, which are ejected outside the cleaning tool at each nozzle 312.

Figure 4B:
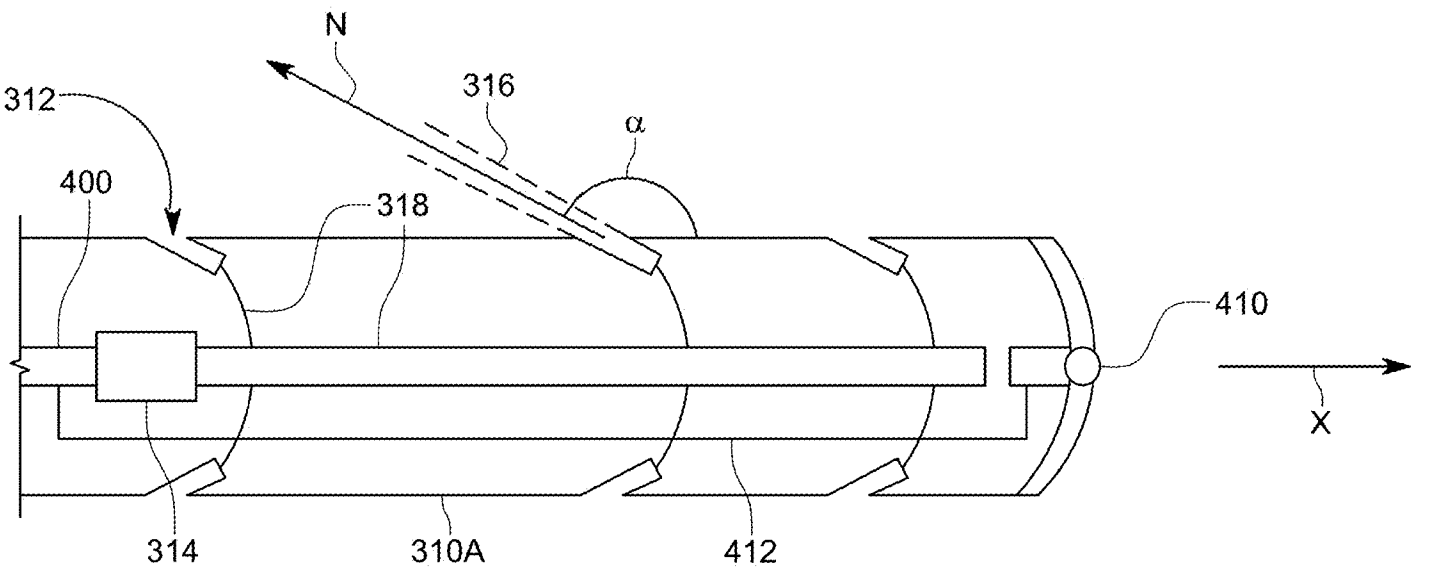
Figure 4C:
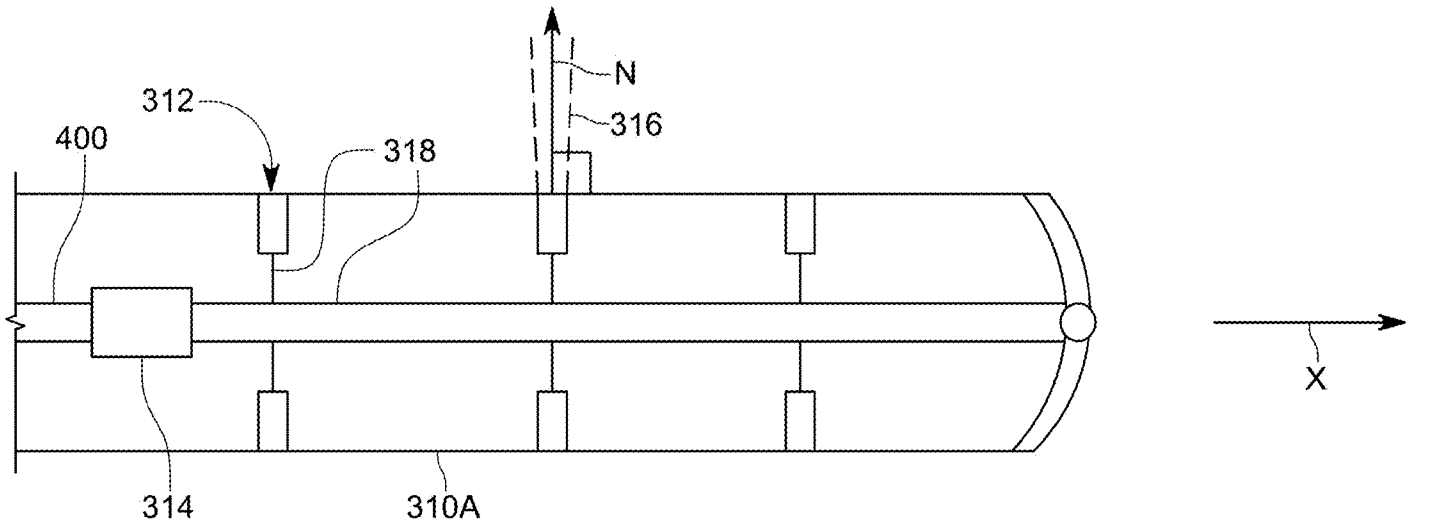
Figure 4D:
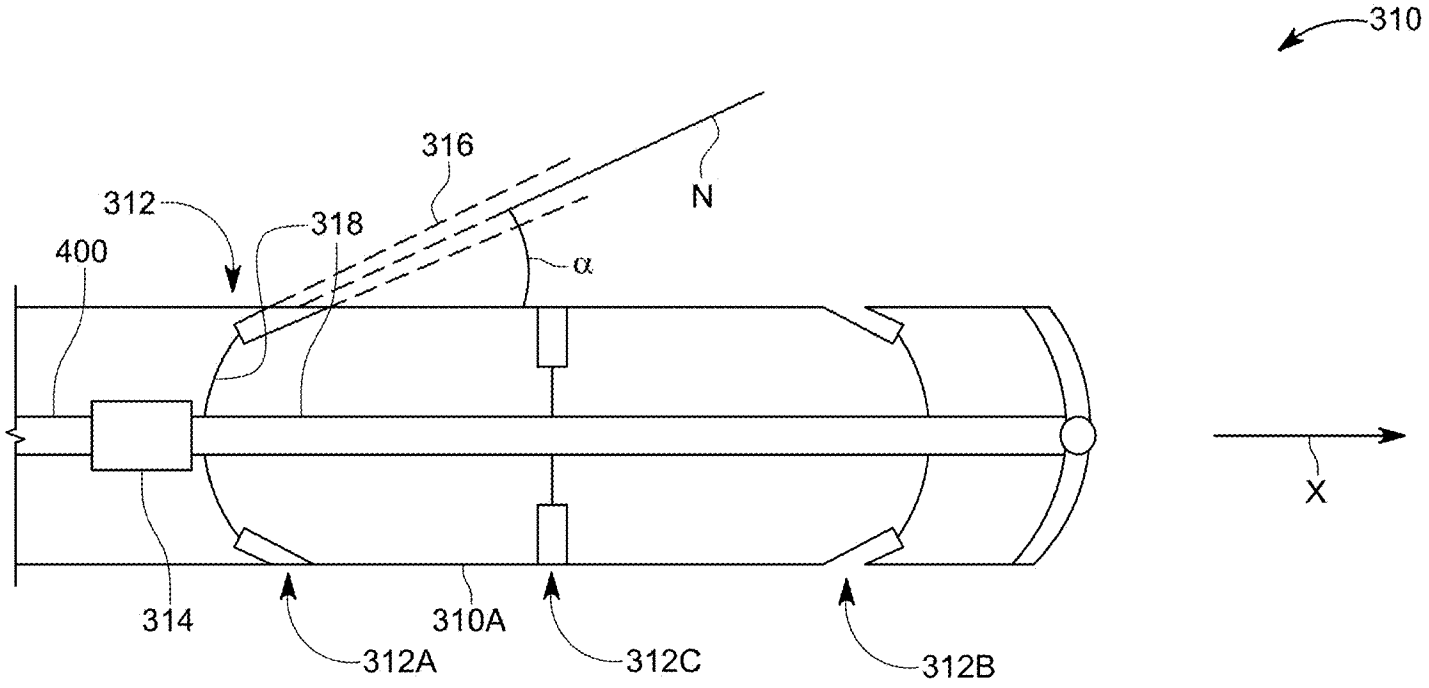

In another embodiment, as illustrated in FIG. 4B, all the nozzles 312 are oriented with an obtuse angle $\alpha$ relative to the longitudinal axis X. In still another embodiment, FIG. 4C shows all the nozzles 312 being oriented perpendicular to the longitudinal axis X while in FIG. 4D a first subset 312A of the nozzles is oriented with an acute angle $\alpha$, a second subset 312B of the nozzles is oriented with an obtuse angle $\alpha$, and a third subset 312C of the nozzles is oriented with a 90 degrees angle. In one embodiment, one or more of the subsets is null. Note that angle $\alpha$ may have any value, and thus, the operator of the well may select the value of the angle $\alpha$ for the cleaning tool.

Not all the incoming fluid stream 400 is diverted to the nozzles 312 as pulsed jets. A part of the incoming fluid stream 400 may be configured to be communicated to a downstream tool, through an output port 410. In one embodiment, the water jet that is ejected at the output port 410 may be pulsed water, as shown in the embodiment of FIG. 4A. However, in another embodiment, as illustrated in FIG. 4B, the incoming water stream 400 is split into two streams, before arriving at the pulse generating module 314, and while the first stream is provided to the pulse generating module 314, the second stream is provided along a different tubing 412 directly to the output port 410. In this way, the output water stream at the output port 410 is not pulsed while the jets at the nozzles 312 are pulsed.

Figure 1:
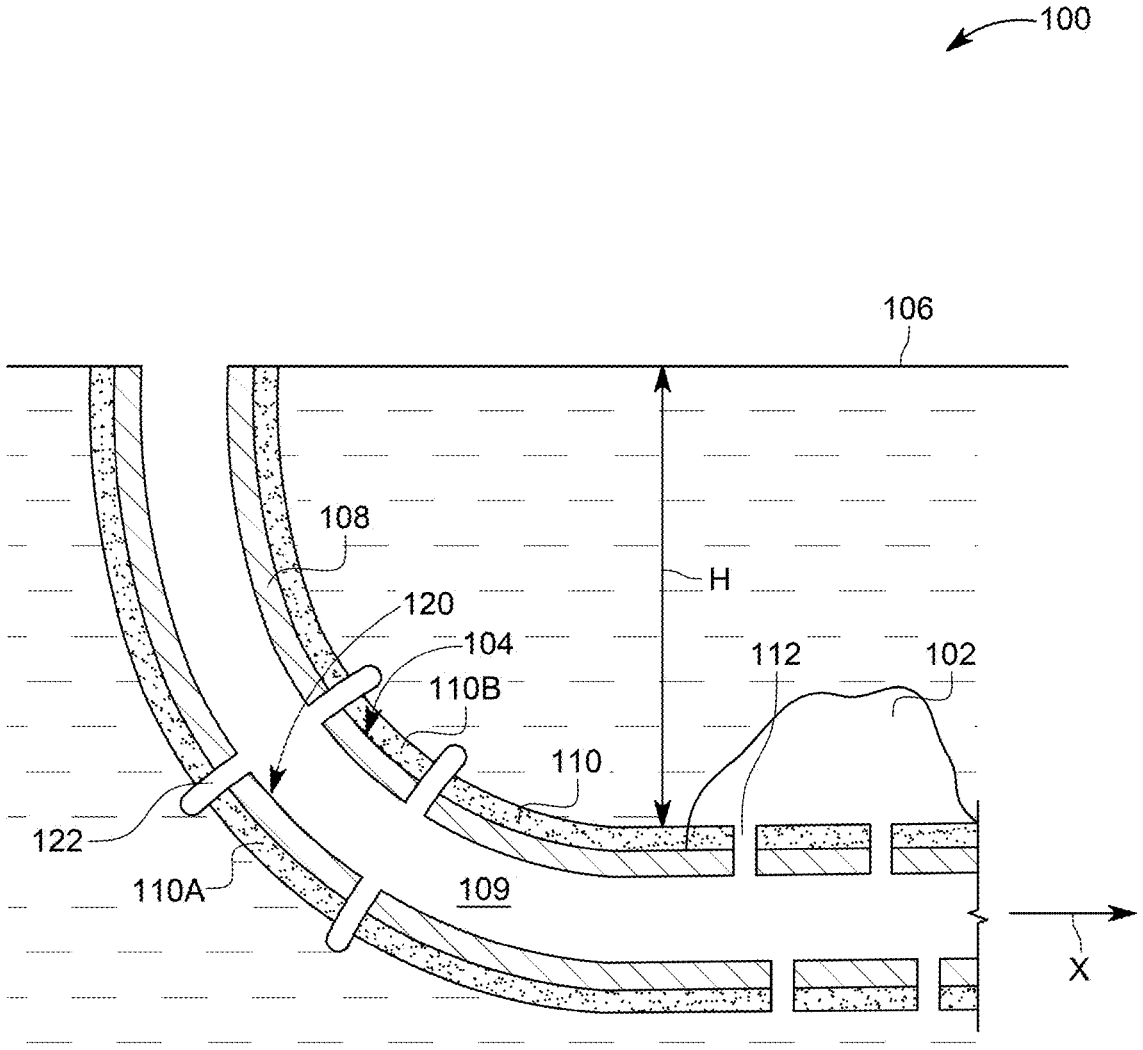
FIG. 1 illustrates a well and plural holes made in a casing for various well completion operations.
Figure 5A:
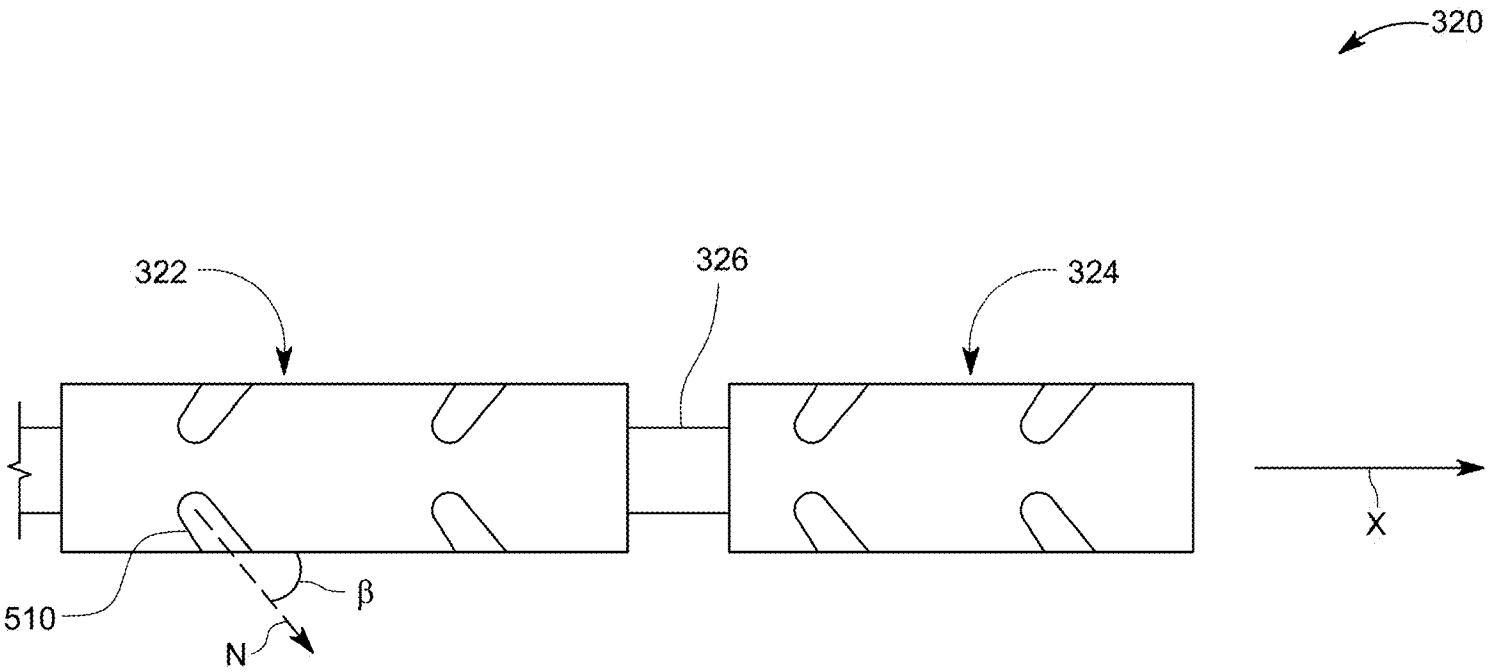
FIGS. 5A to 5D illustrate various configurations of a gun assembly of the novel perf and wash system.
Figure 5B:
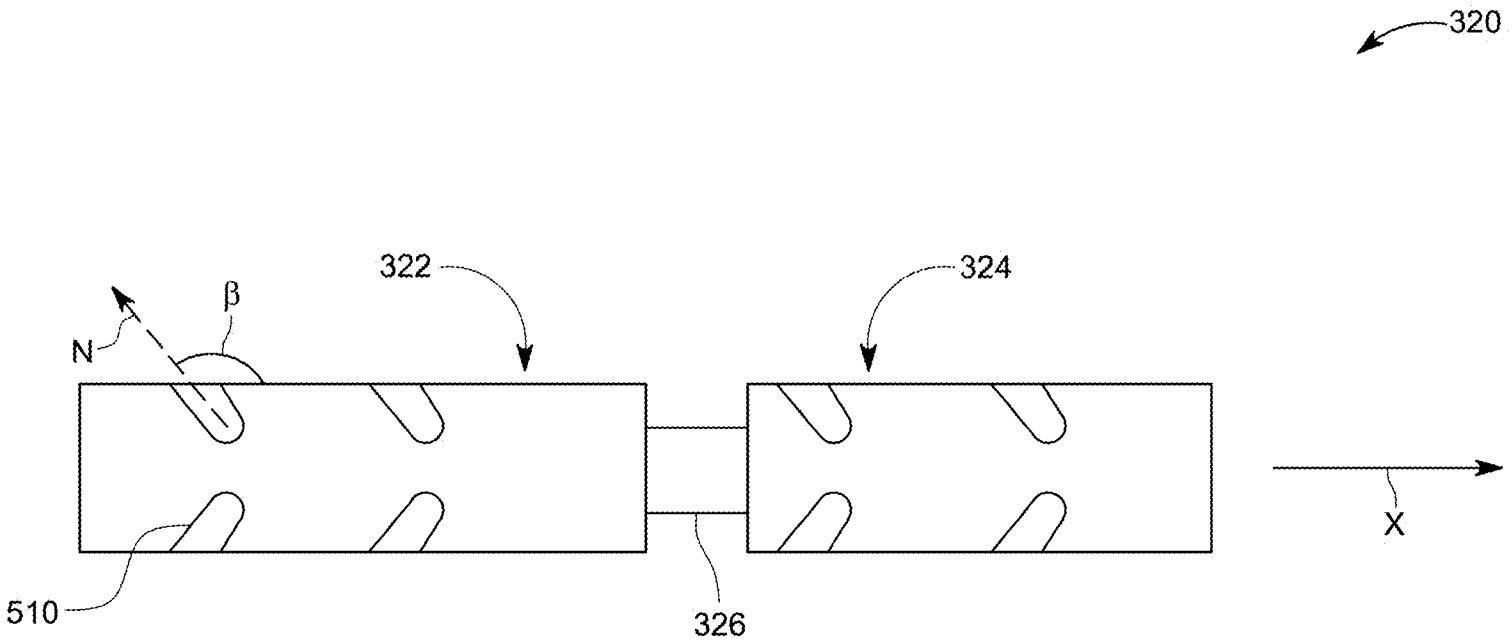
Figure 5C:
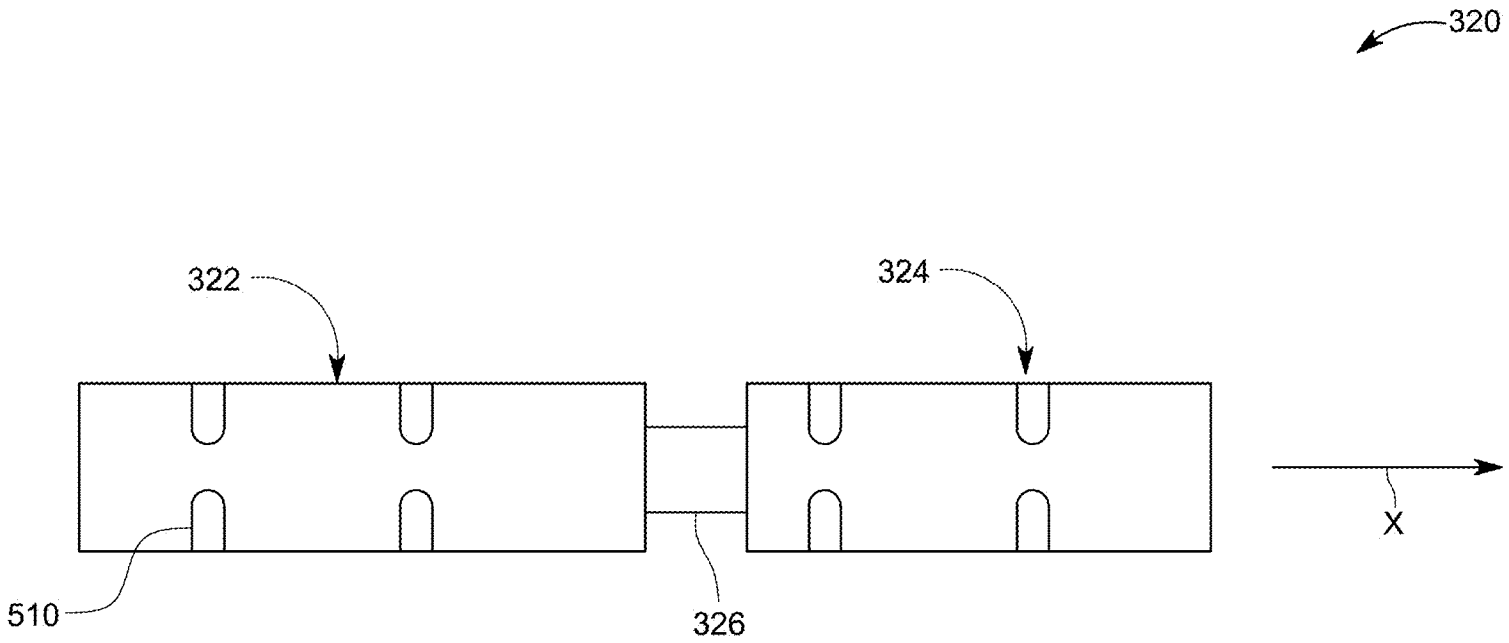
Figure 5D:
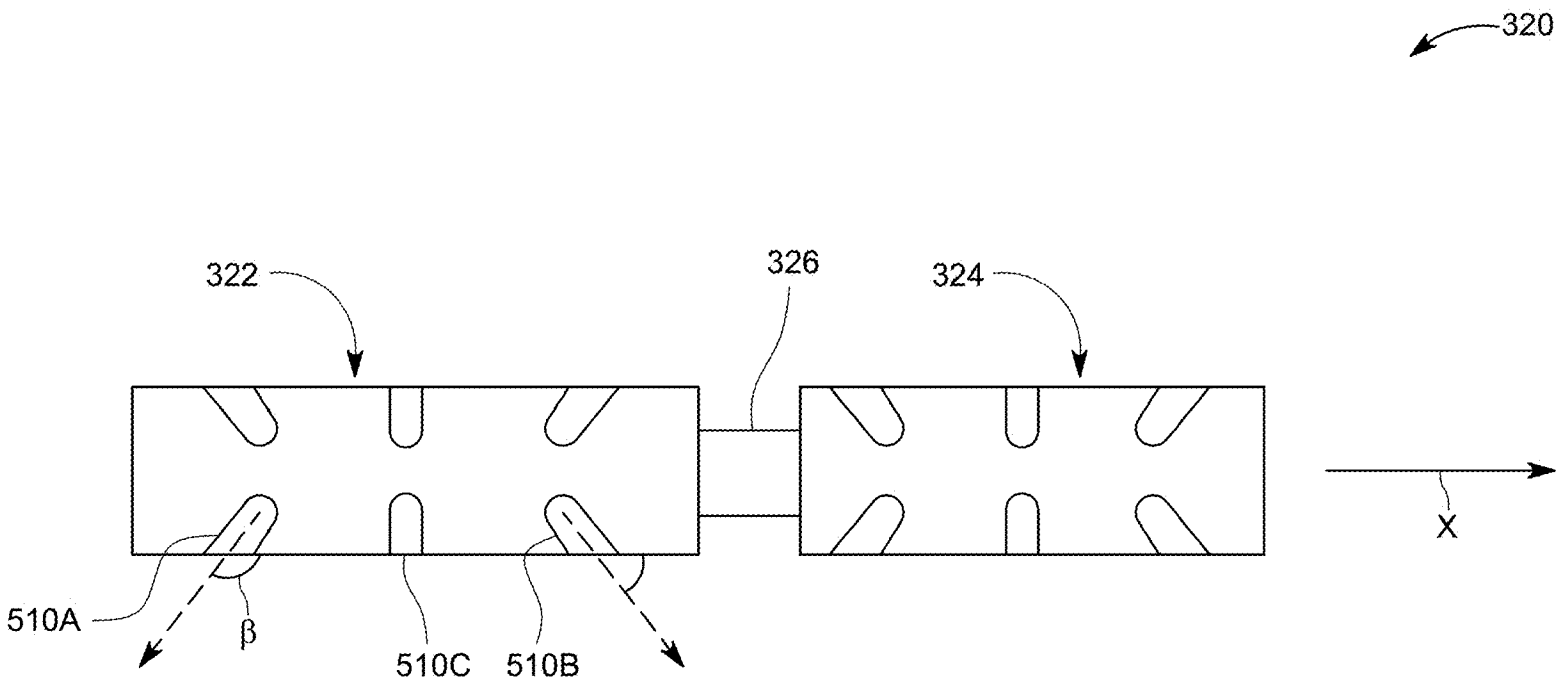

With regard to the perforating gun assembly 320 of the novel pert and wash system 300, it may include plural gun clusters 322 and 324 that are connected to each other with corresponding subs 326, as illustrated in FIG. 5A. Each gun cluster may include one or more shaped charges 510, which when fired, would produce the holes 122 discussed with regard to FIG. 1. Any type of shaped charges may be used. For example, the shaped charges may be selected based on their ability to achieve one or more of the following results: deep penetrating, large hole, good hole, super large hole. In one application, the shaped charges are selected to be slot charges with vertical, horizontal or angled slots or bespoke charges. The shaped charges 510 may be oriented along a direction N, that makes an angle $\beta$ with the longitudinal axis X of the gun assembly. The angle $\beta$ may be acute, as shown in the embodiment of FIG. 5A, or obtuse as shown in the embodiment of FIG. 5B, or 90 degrees, as shown in the embodiment of FIG. 5C, or a combination of obtuse orientation charges 510A, acute orientation charges 510B, and 90 degrees orientation charges 510C, as shown in FIG. 5D.

Figure 2A:
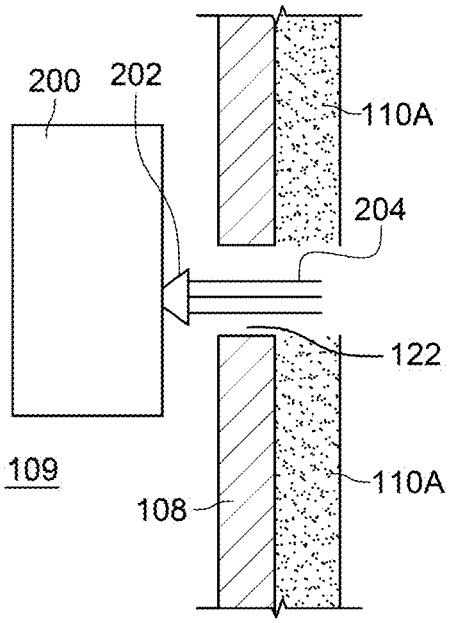
FIGS. 2A and 2B illustrate various configurations of a cleaning tool in relation to the holes made in the casing.
Figure 2B:
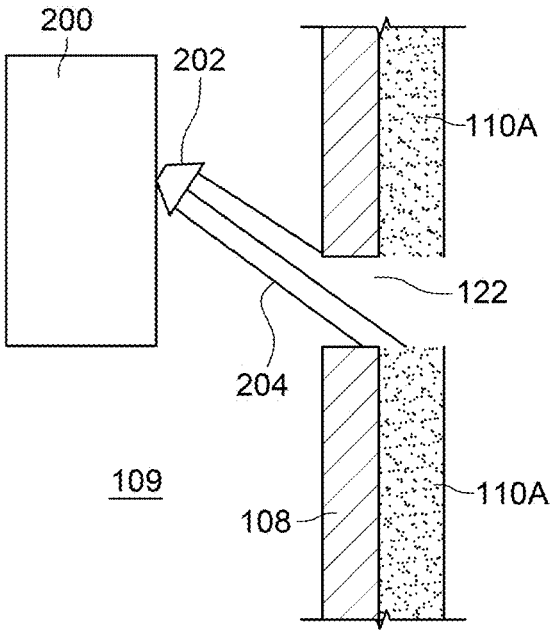
Figure 6A:
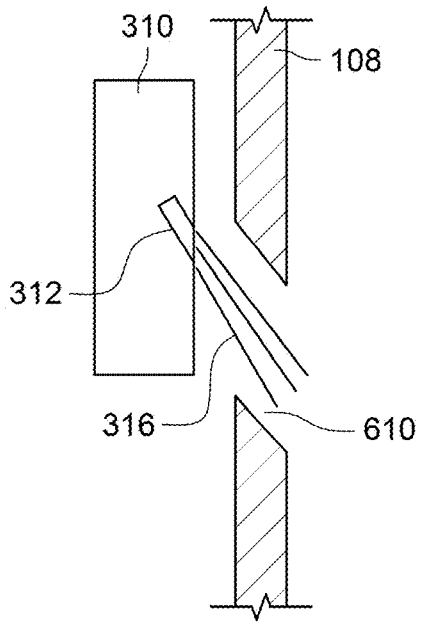
FIGS. 6A and 6B illustrate a selected the cleaning tool for matching a selected gun assembly.
Figure 6B:
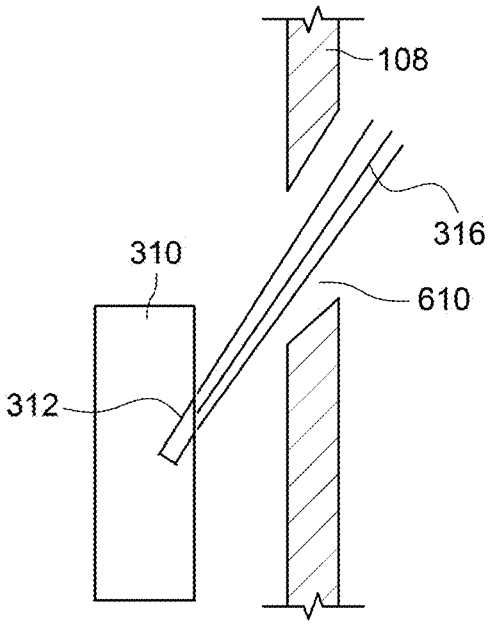

In one embodiment, the perf and wash system 300 is selected so that the orientation(s) of the nozzles of the cleaning tool 310 match the orientation(s) of the shaped charges 510, i.e., angle $\alpha$ is equal to angle $\beta$. This means that for the embodiments shown in FIGS. 4A and 5A, the nozzles and the shaped charges are facing downward, with the same angle relative to the longitudinal axis of the casing. As illustrated in FIG. 6A, a perforating hole 610 made in the casing 108 by the gun assembly 320 has the sides oriented downward, due to the orientation angle of the shaped charges (see FIG. 5A), and the orientation of the water jets 316 generated by the cleaning tool 310 fit the orientation of the hole 610. Because of this matching of the jet orientation and the hole orientation, the efficiency of the water jet 316 is maximized comparative to the embodiment illustrated in FIG. 2A or 2B. The same results are obtained (see FIG. 6B) for the case in which the nozzles of the cleaning tool are oriented upwards, as illustrated in the embodiment of FIG. 4B, and the shaped charges of the gun assembly are oriented upwards, as illustrated in the embodiment of FIG. 5B. The embodiments shown in FIGS. 4C and 5C may also be combined or the embodiments shown in FIGS. 4D and 5D to have a matching orientation angle between the nozzles of the cleaning tool and the shaped charges of the gun assembly.

A common feature of all these embodiments is the novel concept of matching the orientation angle (or angles) of the nozzles of the cleaning tool to the orientation angle (or angles) of the shaped charges distributed along the perforating gun assembly for achieving a matching of the profile of the water jets to the profile of the perforating holes made in the casing. This matching feature allows the water jet to better access the annulus debris (cement, mud, barite, etc.) for better cleaning out the annulus area. If the water jet cleans out the annulus at a faster rate, because of the better access, then this can also speed up the cleaning operation, thus reducing the operational expenditure and saving rig time. Note that annular clean out is critical to achieving good cement placement and a compliant abandonment cement plug.

While the perforating gun assembly 320 may have any type of shaped charges, in one embodiment it is preferred that large angle shaped charges are used to make large holes into the casing. The large holes into the casing are preferred so that a good contact is made between (i) the cement to be poured outside the casing, in the annulus formed between the casing and the wall of the well, and (ii) the plug formed inside the casing. In this regard, such a perforating gun assembly is manufactured by GEODynamics, the assignee of this application, and it is disclosed in U.S. Pat. Nos. 9,038,521 and 9,562,421. Other gun assemblies may be used as long as they generate a desired diameter hole.

Figure 7:
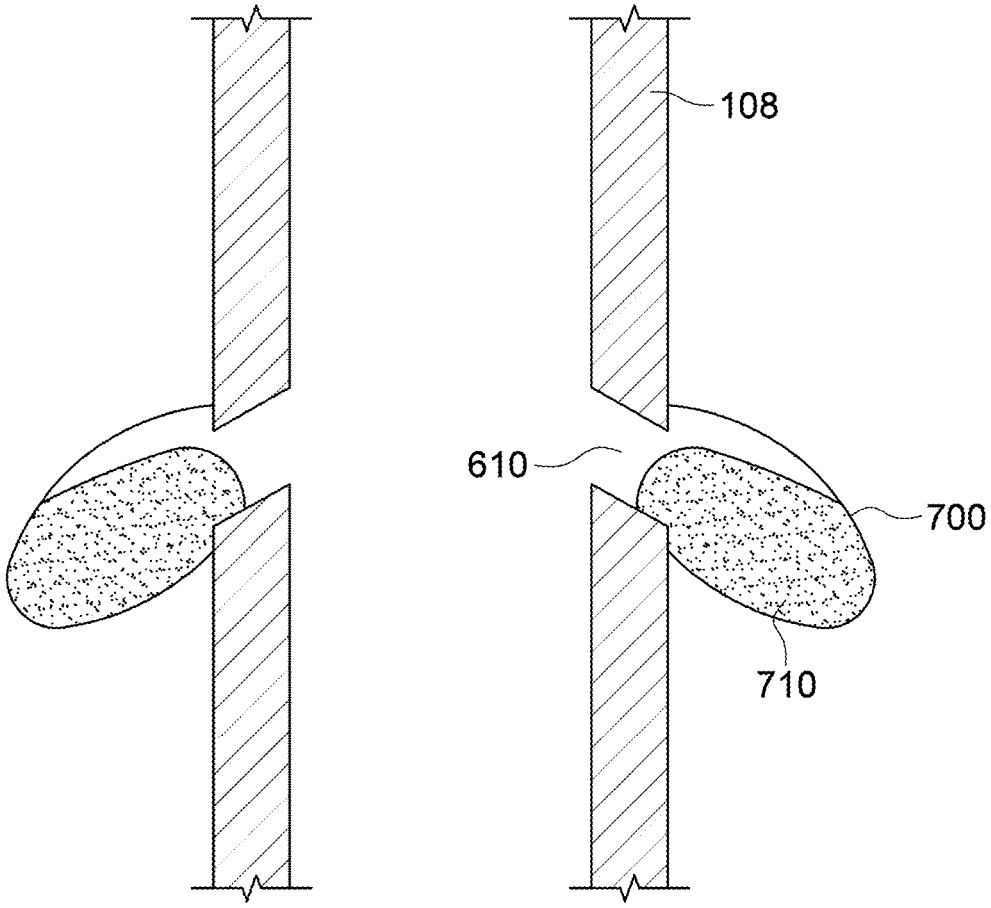
FIG. 7 illustrates a gravel packing operation performed for inclined fracture channels.

In one embodiment, as illustrated in FIG. 7, by using a perforating gun assembly that has the shaped charges oriented downward and also a cleaning tool having the nozzles oriented downwards, it is possible to create perforated channels 700 that also have a downward orientation. Note that these channels may be produced only with the shaped charges of the gun assembly, and/or by using both the shaped charges and the nozzles of the cleaning tool. Then, a material packing tool (not shown) is lowered into the casing and used to pack the channels 700 with a packing material 710, that may include a mixture of sand/gravel and various polymers. The packing process ensures that sand from the formation around the casing does not enter the casing during the oil exploration phase of the well. The fact that the channels 700 are inclined in a downward direction help to maintain the packing material and the sand in the formation on the outside of the casing and also prevents the sand from the formation to enter the casing.

Figure 8A:
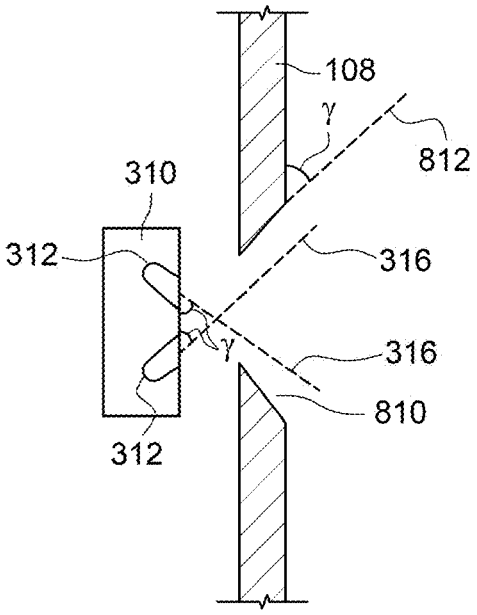
FIGS. 8A and 8B illustrate the use of a pulsed water jet of a cleaning tool with convergent or divergent holes made in a casing.
Figure 8B:
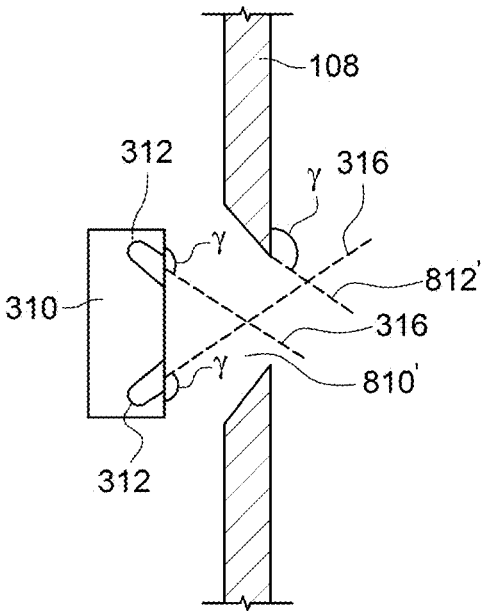

In one embodiment, it is possible to select a perforating gun assembly that is configured so that the shaped charges make a divergent hole 810 in the casing 108, as illustrated in FIG. 8A, or a convergent hole 810', as illustrated in FIG. 8B. Divergent entrance hole shapes may also be created by a single perforating charge. The divergent hole 810 is characterized by an acute angle $\gamma$ formed between a face of the hole 810 and the longitudinal axis of the casing, while the convergent hole 810' is characterized by an obtuse angle $\gamma$. For this case, the shaped charges may be oriented perpendicular to the casing. The cleaning tool is then selected to have the nozzles angled to match the divergence or convergence angle $\gamma$, as also illustrated by FIGS. 8A and 8B. In one application, it is possible to select the nozzles of the cleaning tool to be perpendicular to the casing when the hole is divergent and/or convergent. In another application, it is possible to select a first set of the nozzles of the cleaning tool to be oriented downward, at the angle of the convergent or divergent hole, a second set of the nozzles to be oriented upward, at the angle of the convergent or divergent hole, and a third set of the nozzles to be oriented perpendicular to the casing.

Returning to FIG. 3, the bypass/circulating valves 330 and 332 are known valves, that allow an upstream or downstream fluid encountered in the wellbore to enter the valve through side ports and exit at a port centrally located on a terminal face of the valve, or vice versa. The terminal face of the valve is usually perpendicular to the longitudinal axis of the valve. In this way, when the perforating gun assembly and the cleaning tool are moving through the wellbore, a fluid that needs to move past the perf and wash system 300 can enter through one of the ports of the bypass valve and exit through another port, located at an opposite end of the bypass valve. These valves are helpful especially if a diameter of the cleaning tool is very close to an inner diameter of the casing and/or seals are located on the cleaning tool or at the ends of the cleaning tool so that a fluid cannot pass the cleaning tool or barely can pass the cleaning tool, at an interface between the cleaning tool and the casing. Any known bypassing valve can be used for the perf and wash system discussed herein.

The cement base assembly plug 334 is placed between the cleaning tool 310 and the perforating gun assembly 320 and it is configured to fully plug the bore of the casing when activated. The plug 334 may be hydraulically activated as known in the art. Then it is possible, for example, to release a ball from the head of the well. The ball will travel down the bore of the casing and may stop in a seating of the plug 334, thus, fully closing the casing. However, it is possible to activate the plug 334 in a different way, for example, using a setting tool.

The automatic gun release module 336 sits at the top of the perforating gun assembly 320 and is configured to release the gun assembly 320 when activated. When this happens, the gun assembly 320 falls freely inside the well, especially if the well is vertical. If the well is horizontal, the gun assembly remains in position and the rest of the perf and wash system is moved independent of the gun assembly. The gun release module 336 may stay with the gun assembly or with the cleaning tool. The automatic gun release module 336 may be activated with a ball, similar to the plug 334, or by other means, as is known in the art. It is also possible that the automatic gun release may not be required as it may be preferred in certain applications that the perforating guns are retrieved from the well.

Figure 9:
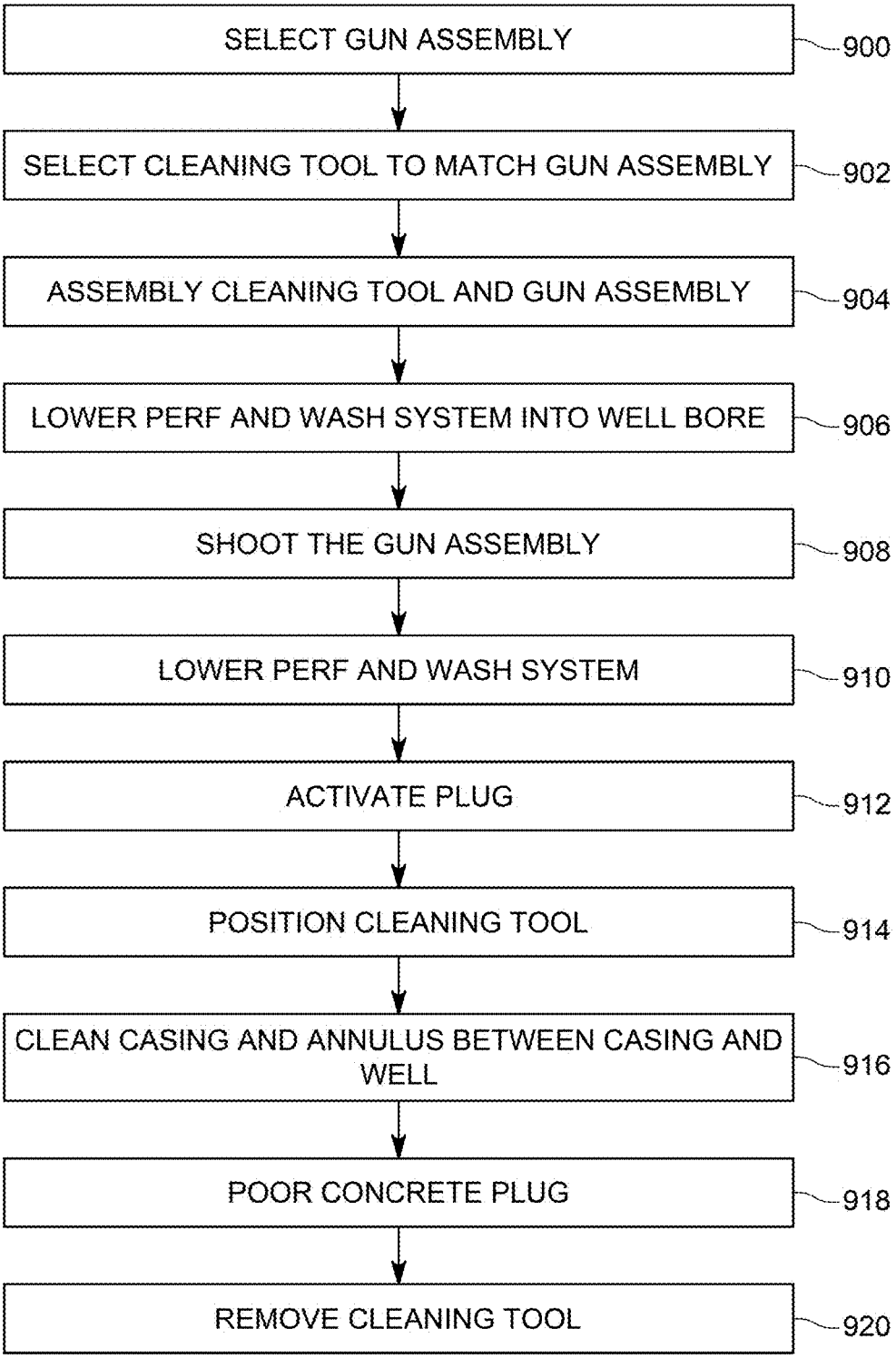
FIG. 9 is a flowchart of a method for making a concrete plug inside a casing.

A method for preparing a well for abandonment that uses the novel perf and wash system 300 is now discussed with regard to FIG. 9. The method starts in step 900 with selecting a perforating gun assembly 320. This selection may involve various features of the system, for example, the number of shaped charges, the sizes of the shaped charges, the angular orientation of the shaped charges, etc. In step 902, a cleaning tool 310 is selected. The selection of the cleaning tool 310 is based on the selection of the gun assembly 320, i.e., if the shaped charges of the gun assembly have been selected to make a certain angle with the longitudinal axis of the casing, the nozzles of the cleaning tool 310 are selected to have an angle in the same range.

For example, suppose that the shaped charges of the gun assembly are selected to make a 25 degrees angle, upward or downward with the casing. The value of 25 degrees is arbitrary and other values may be used. Then the nozzles of the cleaning tool are selected to make an angle of 25 degrees, plus or minus 20% of that value. In one application, the angle of the nozzles is selected to be 25 degrees plus or minus 10% of that value. In still another application, the angle of the nozzles is selected to be 25 degrees plus 5% of that value. In yet another application, the angle of the nozzles is selected to be exactly the angle of the shaped charges. More generically, the angle of the nozzles is selected to be substantially the angle of the shaped charges, wherein the term "substantially" includes all of the above ranges and values. In still another application, it is possible that the gun assembly has been selected in step 900 to have a first set of charges oriented with an acute angle relative to the casing and a second set of charges oriented with an obtuse angle. For this case, the nozzles of the cleaning tool are selected such that a first set of them has substantially the acute angle and a second set of the nozzles has substantially the obtuse angle of the charges. In yet another application, it is possible that the gun assembly has been selected in step 900 to have a first set of charges oriented with an acute angle relative to the casing, a second set of charges oriented with an obtuse angle, and a third set of charges oriented perpendicular to the casing. For this situation, the nozzles of the cleaning tool are selected in step 902 (i) either to be aligned only with the upward and downward charges, (ii) or to be aligned with the upward, downward, and perpendicular charges.

Figure 10A:
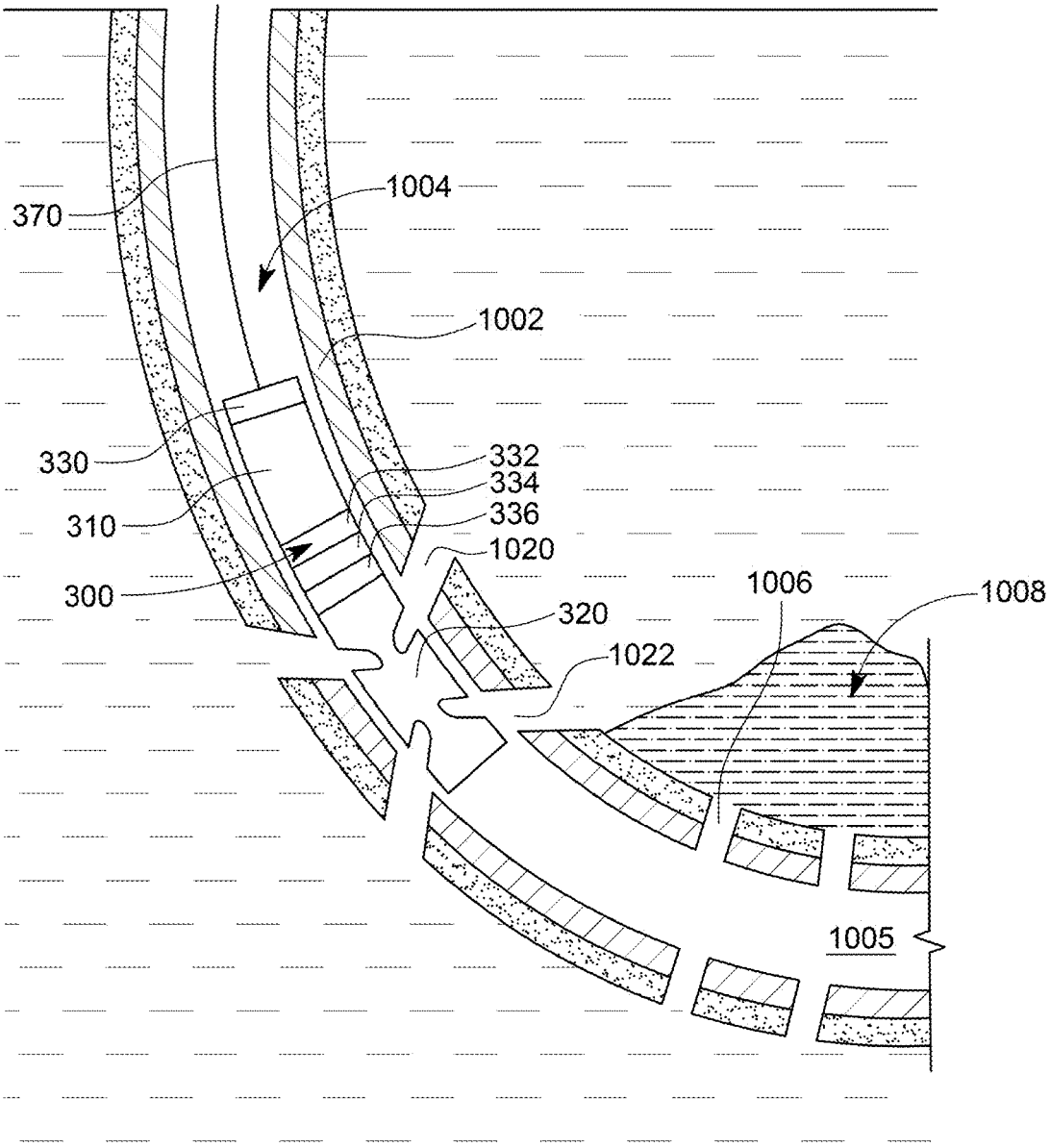
FIGS. 10A to 10E illustrate various phases of the perf and wash operations performed with the novel perf and wash system.
Figure 10B:
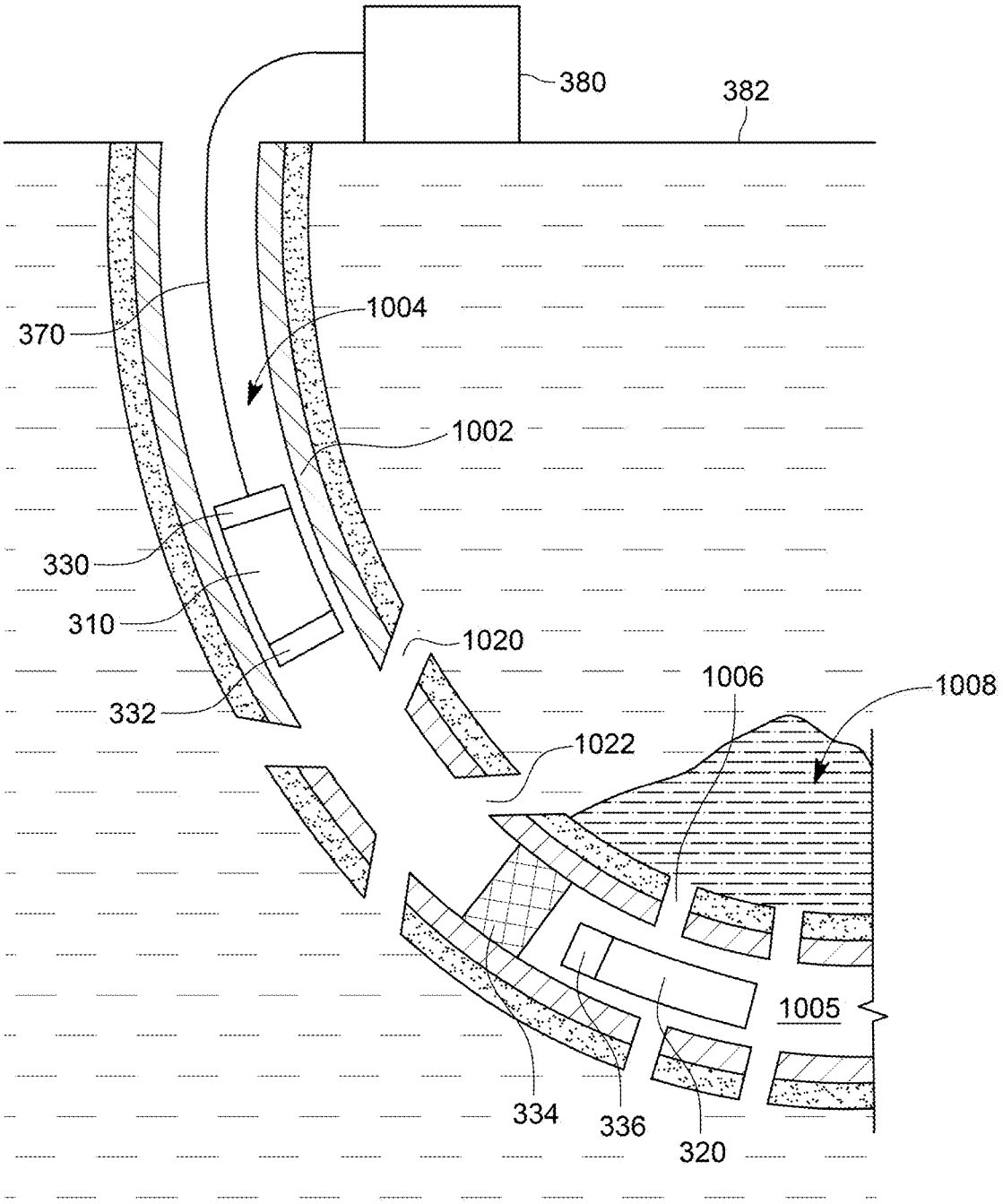

In step 904, the selected gun assembly and the selected cleaning tool are assembled with various other elements (for example, bypass valves and gun release module) to form the perf and wash system 300 shown in FIG. 3. Then, in step 906, the perf and wash system 300 is lowered into the casing 1002 of a well 1004, with a coiled tubing 370 or a string or other delivery system, as shown in FIG. 10A. FIG. 10A schematically shows the tubing 370 as a line, but one skilled in the art would understand that tubing 370 is configured as a conduit for a fluid from the surface to the perf and wash system 300, so that the cleaning tool can generate the pulsed water jets. The tubing 370 may be replaced with any other similar tool or may be used with any additional tool that is necessary for each particular abandonment work. Note that previous perforation holes 1006 have been made in the casing 1002, with other perforation gun assemblies, for connecting the bore 1005 of the well 1004 to the oil formation 1008. The oil and gas has been extracted from the formation 1008, and as the production is not economical anymore, the well needs to be abandoned. Thus, the perf and wash system 300 needs to make additional holes 1020 and 1022, above the existing perforating holes 1006. Therefore, the gun assembly 300 is shot in step 908 to make the holes 1020 and 1022. While the holes 1020 are oriented in an upward direction and the holes 1022 are oriented in a downward direction, as discussed above with regard to the previous embodiments, it is possible to orient the shaped charges of the gun assembly in other directions or a combination of directions. Still in step 908, the automatic gun release module 336 is activated so that the gun assembly 320 becomes free and falls back into the well, as illustrated in FIG. 10B.

Then, in step 910, the remaining parts of the perf and wash system 300 are further lowered so that the plug 334 is placed below the last hole 1020 or 1022 made with the gun assembly 320 and then activated to seal off the bottom part of the well, i.e., the part of the well below the plug 334. At the same time, the plug 334 is separated from the cleaning tool 310 and the cleaning tool with the associated bypass valves 330 and 332 is positioned in step 914 above the holes 1020 and 1022, as illustrated in FIG. 10B. Note that the bypass valves 330 and 332 help the cleaning tool to move up and down along the casing by allowing the existing fluid inside the casing to bypass the cleaning tool.

Figure 10C:
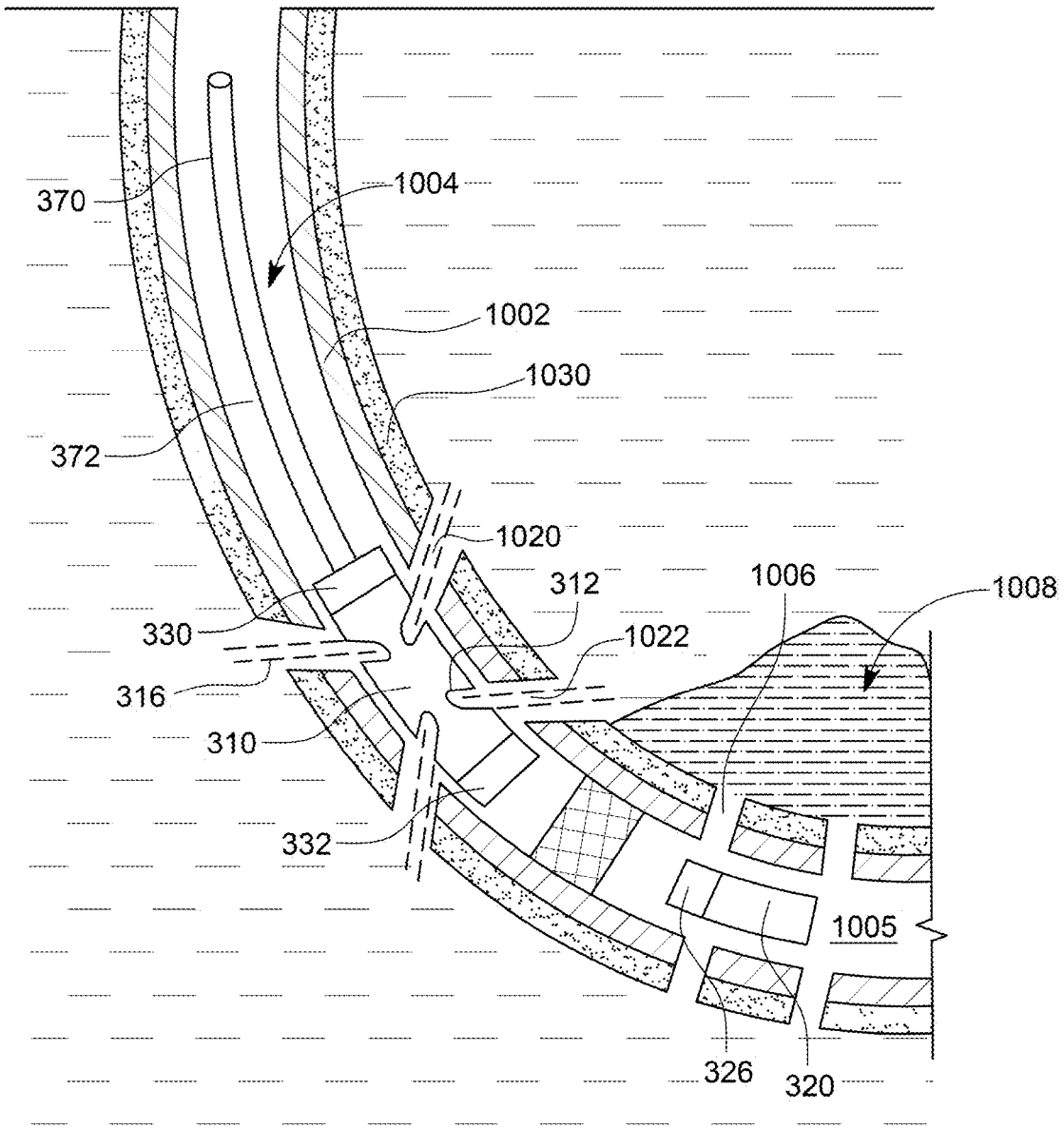
Figure 10D:
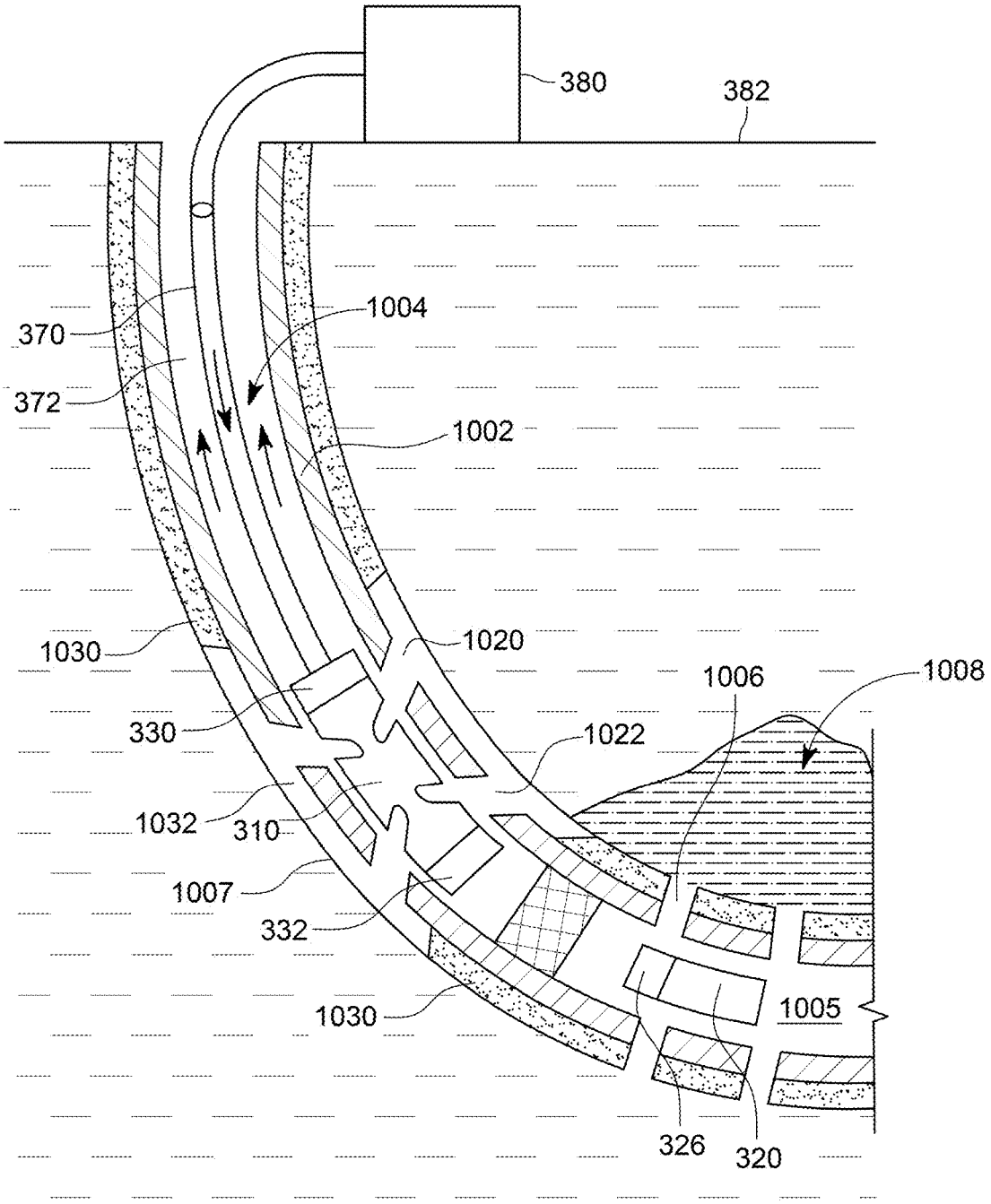

In step 916, the cleaning tool 310 is activated by providing water from the surface 382, with a pump 380, through the tubing 370, to the cleaning tool 310, which generates pulsed water jets 316 at the nozzles 312. The pulsed water jets 316 are used to clean the interior of the casing and also the cement 1030 that is present in the annulus between the wall of the well and the casing, as illustrated in FIG. 10C. Note that the water jets 316 are pulsed, i.e., they exhibit a hammer effect, which is advantageous in breaking up the cement 1030 and pulverizing it so that small debris can be brought to the surface. During this step, the cleaning tool is moved downwards across the holes 1020 and 1022 to clean all the cement behind the casing, as shown in FIG. 10D. In one embodiment, the cleaning tool may be moved repeatedly up and down until all the debris has been removed. Note that the bypassing valves 330 and 332 ensures that the water and debris are passing past the perf and wash system and then it is sent back to the surface, through the annulus 372 formed between the tubing 370 and the casing 1002. In other words, the fluid (e.g., water or a mixture of water with other chemicals) that is used to clean the casing and the annulus 1032, which is formed between the casing 1002 and the wall 1007 of the well 1004, is pumped down the tubing 370, for example, with the pump 380 that is located at the surface 382, and the water with the debris removed from the annulus 1032 is then forced to the surface 382, through the annulus 372, as shown in FIG. 10D.

Figure 10E:
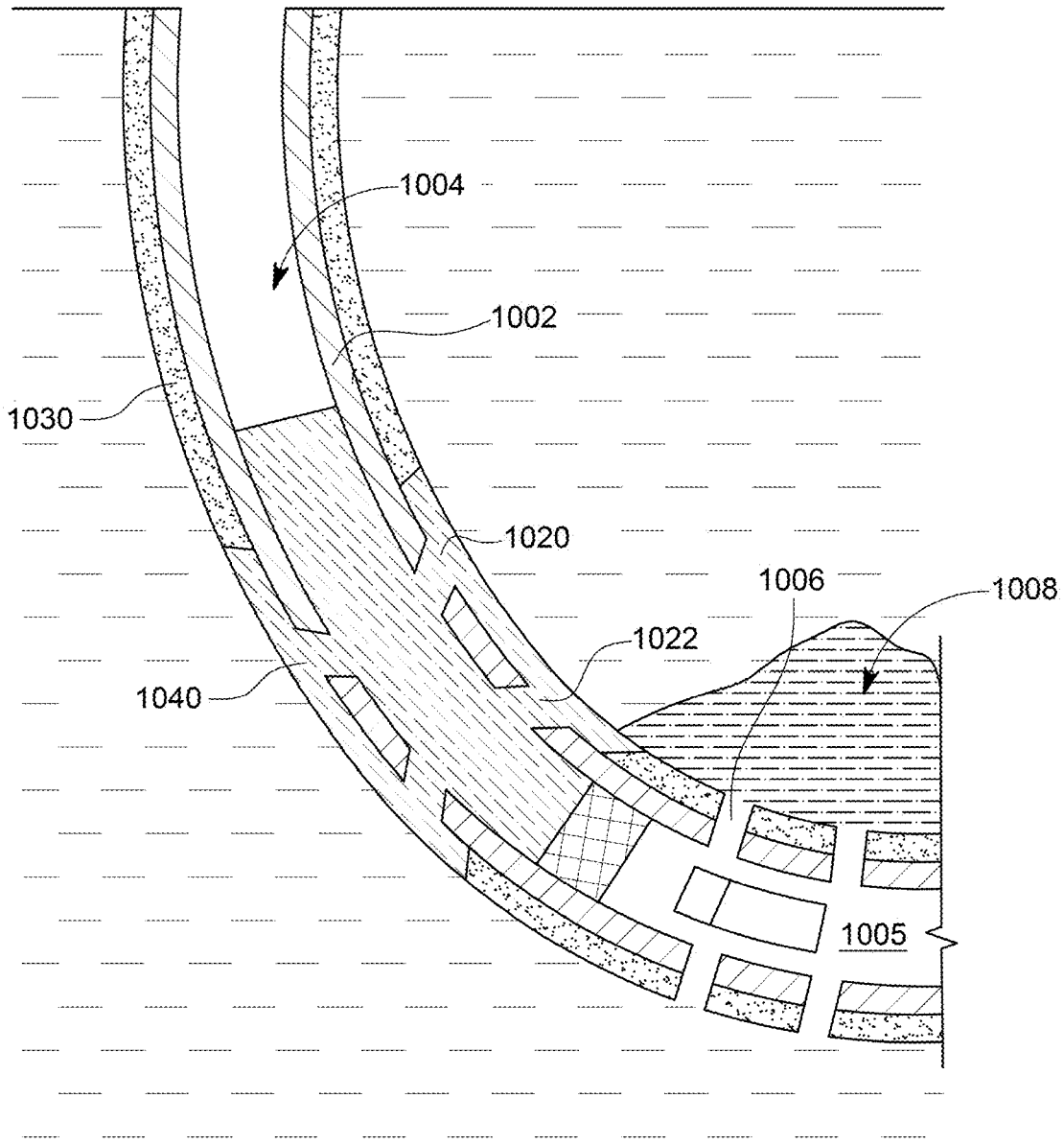

When the annulus 1032 is deemed to be clean, cement is pumped in step 918 through the tubing 370 and either the bypass valves 330 an 332, or the cleaning tool 310, or with another device, for filing the casing 1002 and the annulus 1032 as illustrated in FIG. 10E. Thus a plug 1040 is formed that extends both inside and outside the casing 1002. Then, in step 920, the cleaning tool is removed and this section of the well is considered plugged.

Figure 11:
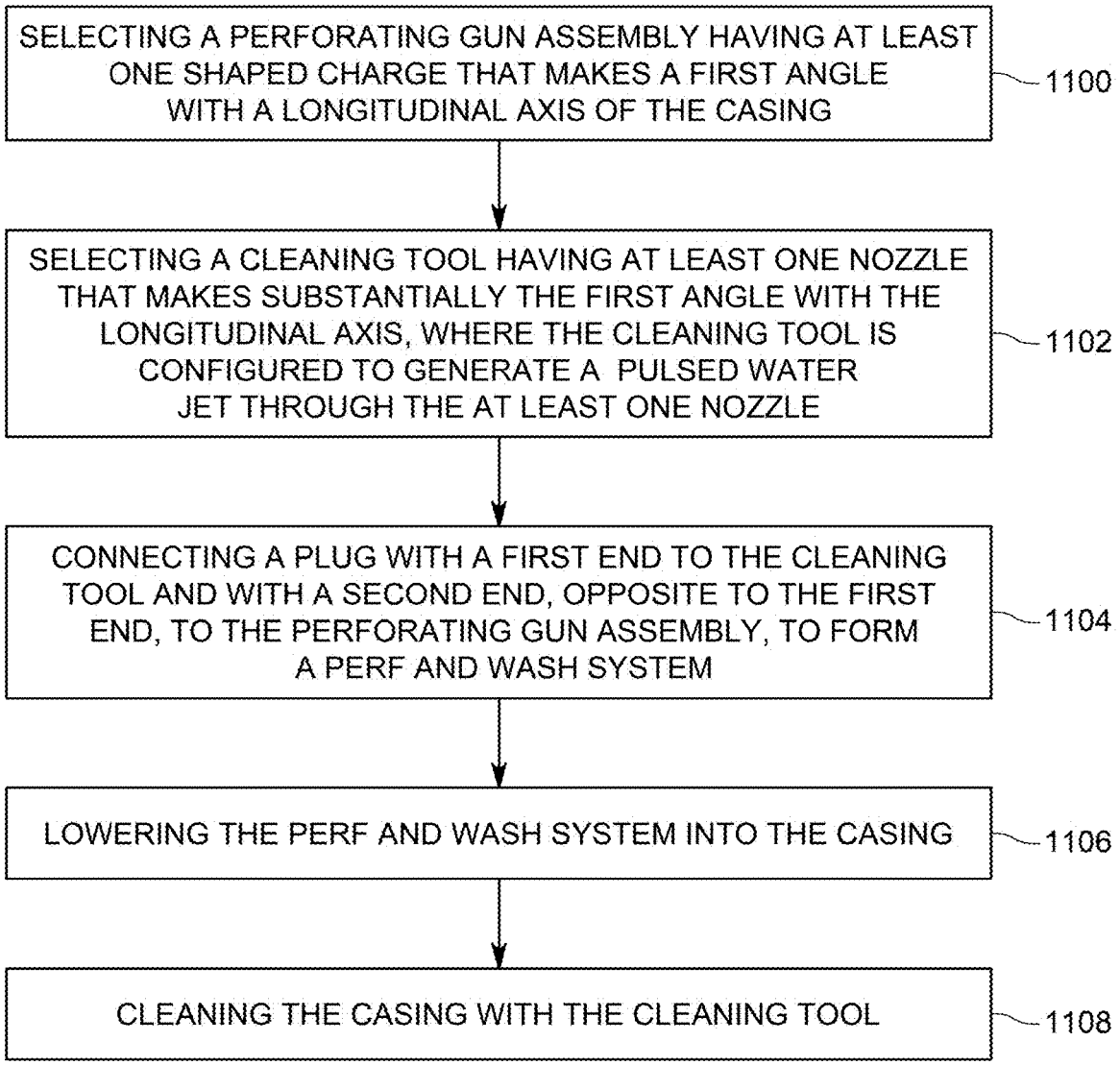
FIG. 11 is a flowchart of a method for cleaning a casing in a well.

A method for cleaning a casing in a well is now discussed with regard to FIG. 11. The method includes a step 1100 of selecting a perforating gun assembly having at least one shaped charge that makes a first angle with a longitudinal axis of the casing, a step 1102 of selecting a cleaning tool having at least one nozzle that makes substantially the first angle with the longitudinal axis, where the cleaning tool is configured to generate a pulsed water jet through the at least one nozzle, a step 1104 of connecting a plug with a first end to the cleaning tool and with a second end, opposite to the first end, to the perforating gun assembly, to form a perf and wash system, a step 1106 of lowering the perf and wash system into the casing, and a step of cleaning the casing with the cleaning tool.

The method may further include a step of activating the perforating gun system to make holes into the casing and a step of releasing the perforating gun system from the perf and wash system. In one application, the holes are convergent or divergent. The holes may be inclined downward relative to the casing and gravel is packed into the holes.

The method may further include a step of setting the plug upstream from the holes made by the perforating gun system to close the casing and a step of separating the plug from the cleaning tool. Further, the method may also include a step of positioning the cleaning tool above the holes made by the perforating gun system, and a step of cleaning the casing and cement formed in an annulus between the casing and a wall of the well, with the pulsed water jet. Furthermore, the method may include a step of pouring cement into the casing and the annulus to form a cement plug.

While the various features illustrated above have been discussed in the context of the oil and gas industry, those skilled in the art would understand that the novel features are applicable to devices in any field. For example, the pert and wash system may be used for water wells or other types of wells.

The disclosed embodiments provide methods and systems for perforating a well, cleaning an annulus between the casing and the walls of the well, and forming a concrete plug to close the well. While the above embodiments have been discussed with regard to plugging the casing and the annulus between the casing and the well, it is possible to use the same method to plug a string and the annulus between the string and the casing. It should be understood that this description is not intended to limit the invention. On the contrary, the various embodiments are intended to cover alternatives, modifications and equivalents, which are included in the spirit and scope of the invention as defined by the appended claims. Further, in the detailed description of the embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A perf and wash system (300) for plugging a casing and wellbore, the perf and wash system comprising:

a cleaning tool (310) having at least one nozzle (312) making a first angle with a longitudinal axis of the system;

a perforating gun assembly (320) having at least one shaped charge (510) making a second angle with the longitudinal axis; and a plug (334) connected with a first end to the cleaning tool (310) and with a second end, opposite to the first end, to the perforating gun assembly (320), wherein the first angle is substantially equal to the second angle and the first and second angles are different than 90 degrees.

2. The system of claim 1, wherein the cleaning tool is configured to generate a pulsing water jet through the at least one nozzle.

3. The system of claim 1, wherein the first and second angles are both acute or both obtuse.

4. The system of claim 1, wherein the at least one nozzle of the cleaning tool includes a first set of nozzles having the first angle and a second set of nozzles having a third angle, which is different from the first angle.

5. The system of claim 4, wherein the at least one shaped charge of the perforating gun assembly includes a first set of shaped charges having the second angle, and a second set of shaped charges having a fourth angle, different from the second angle.

6. The system of claim 5, wherein the second angle is substantially equal to the fourth angle.

7. The system of claim 6, wherein one of the first and third angles is acute and another one of the first and third angles is obtuse.

8. The system of claim 5, wherein the at least one nozzle includes a third set of nozzles that are perpendicular to the longitudinal axis.

9. The system of claim 8, wherein the at least one shaped charge includes a third set of charges that are perpendicular to the longitudinal axis.

10. The system of claim 1, wherein the plug is configured to be set to close the casing and to detach from the cleaning tool.

11. The system of claim 1, further comprising:

first and second bypassing valves that are located to sandwich the cleaning tool; and an automatic gun release module located between the plug and the perforating gun assembly and configured to release the perforating gun assembly.

12. A perf and wash system (300) for plugging a casing, the perf and wash system comprising:

a cleaning tool (310) having at least one nozzle (312);

a perforating gun assembly (320) having at least one shaped charge (510); and a plug (334) connected with a first end to the cleaning tool (310) and with a second end, opposite to the first end, to the perforating gun assembly (320), wherein the cleaning tool is configured to generate a pulsing water jet through the at least one nozzle.

13. The system of claim 12, wherein the at least one nozzle makes a first angle with a longitudinal axis of the system, the at least one shaped charge makes a second angle with the longitudinal axis, the first angle is equal to the second angle, and the first and second angles are different than 90 degrees.

14. The system of claim 13, wherein the at least one nozzle of the cleaning tool includes a first set of nozzles having the first angle and a second set of nozzles having a third angle, which is different from the first angle, and the at least one shaped charge of the perforating gun assembly includes a first set of shaped charges having the second angle, and a second set of shaped charges having a fourth angle, different from the second angle.

15. The system of claim 14, wherein the third angle is substantially equal to the fourth angle.

16. A method for cleaning a casing in a well, the method comprising:

selecting (1100) a perforating gun assembly (320) having at least one shaped charge (510) making a first angle with a longitudinal axis of the casing;

selecting (1102) a cleaning tool (310) having at least one nozzle (312) making substantially the first angle with the longitudinal axis, wherein the cleaning tool is configured to generate a pulsed water jet (316) through the at least one nozzle (312);

connecting (1104) a plug (334) with a first end to the cleaning tool (310) and with a second end, opposite to the first end, to the perforating gun assembly (320), to form a pert and wash system (300);

lowering (1106) the pert and wash system (300) into the casing; and cleaning (1108) the casing with the pulsed water jet (316) of the cleaning tool (310).

17. The system of claim 16, further comprising:

activating the perforating gun system to make holes into the casing; and releasing the perforating gun system from the pert and wash system.

18. The method of claim 17, wherein the holes are convergent or divergent.

19. The method of claim 17, wherein the holes are inclined downward relative to the casing and gravel is packed into the holes.

20. The method of claim 17, further comprising:

setting the plug downstream from the holes made by the perforating gun system to close the casing; and separating the plug from the cleaning tool.

21. The method of claim 20, further comprising:

positioning the cleaning tool above the holes made by the perforating gun system; and cleaning the casing and cement formed in an annulus between the casing and a wall of the well, with the pulsed water jet.

22. The method of claim 21, further comprising:

pouring cement into the casing and the annulus to form a cement plug.

* * * * *